United States Patent [19]

Duncan

[11] 4,007,671

[45] Feb. 15, 1977

[54] FOLDING BLANK PRESS WITH MEANS TO SCARIFY BLANK SURFACES INTENDED FOR GLUING

[76] Inventor: Gordon Duncan, 148-26 87th Ave., Jamaica, N.Y. 11435

[22] Filed: Aug. 28, 1975

[21] Appl. No.: 608,632

[52] U.S. Cl. ..... 93/58 ST; 93/58.3; 118/37; 156/535

[51] Int. Cl.[2] ..... B26D 3/08

[58] Field of Search ..... 156/535; 118/72, 35, 118/37, 44; 93/58 ST, 58 R, 58 H, 58 P, 58.3, 36 MM; 53/383; 83/1, 2, 6, 7, 8, 9, 11

[56] References Cited

UNITED STATES PATENTS

| | | | |
|---|---|---|---|
| 1,904,812 | 4/1933 | Albert | 156/535 |
| 2,338,635 | 1/1944 | Galber | 188/72 X |
| 2,655,844 | 10/1953 | Sillars | 93/58.3 |
| 2,659,340 | 11/1953 | Zinn, Jr. | 93/36 MM |
| 3,194,474 | 7/1965 | Rumberger | 93/36 MM UX |

*Primary Examiner*—James F. Coan
*Attorney, Agent, or Firm*—Edward Halle

[57] ABSTRACT

Folding blank processing apparatus with scarifying means to scar, or distort, the surface of the paper or board of the blank to produce pock marked surface scarring on the blank adjacent a score line fold for the purpose of holding adhesive at the scarified area to complete the construction of a box, or other means, out of the folded blank.

9 Claims, 6 Drawing Figures

FOLDING BLANK PRESS WITH MEANS TO SCARIFY BLANK SURFACES INTENDED FOR GLUING

BRIEF DESCRIPTION OF THE INVENTION

The invention comprises means to scarify the surface of a blank of paper, or board, which is intended to be made into a box or other construction. In the usual art of making blanks for such boxes or items, a blank is cut and then placed in a press having scoring and/or cutting rules to provide a blank with fold lines for folding the blank. The blank is then further processed by folding the blank and then gluing it near a corner fold to provide the body portion for the frame of the construction. The main object of this invention is to provide a means in the press for scarifying the surface of the blank where the adhesive is to be applied to improve the surface which is to hold the glue or adhesive applied, and to grip the glue as it becomes tacky and hardens.

This is accomplished by providing a means such as a die having scarifying element extensions which will either cut into, or deform, a surface of the blank to provide scratches, pock marks, or other indentations to serve as grip holds for the glue as it is applied and hardens. The scarifying means, or die, is placed on a press bed alongside a cutting or scoring rule so that the surface of the blank will be scarified in the vicinity of an end of the blank, or of a fold line. The main advantage of the invention is that it provides for a better glued joint in a box construction or the like. Further objects and advantages of the invention will appear in the specification hereinbelow.

DESCRIPTION OF THE DRAWINGS

Similar numerals apply to similar parts throughout the several views.

DETAILED DESCRIPTION OF THE INVENTION

Figure 6:
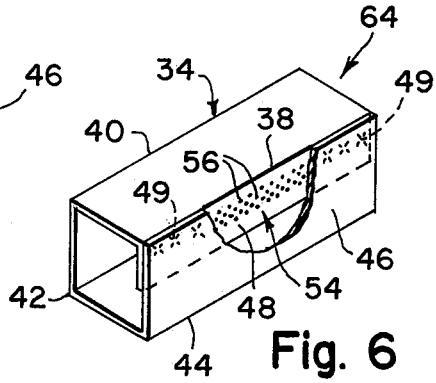
FIG. 6 is a perspective view of a folded construction made from the blank of FIG. 5 with parts cut away.

The invention is comprised in the usual press 20, adapted for cutting a blank 34 and/or forming score lines such as lines 38, 40, 42 and 44 in the blank 34, usually made of paper or board and intended to be folded into a boxlike structure 64, such as shown in FIG. 6. The press 20 includes a press bed having a surface 22 and a roller 24. The functions of the press bed 22 and the roller 24 are well known in the art.

Figure 1:
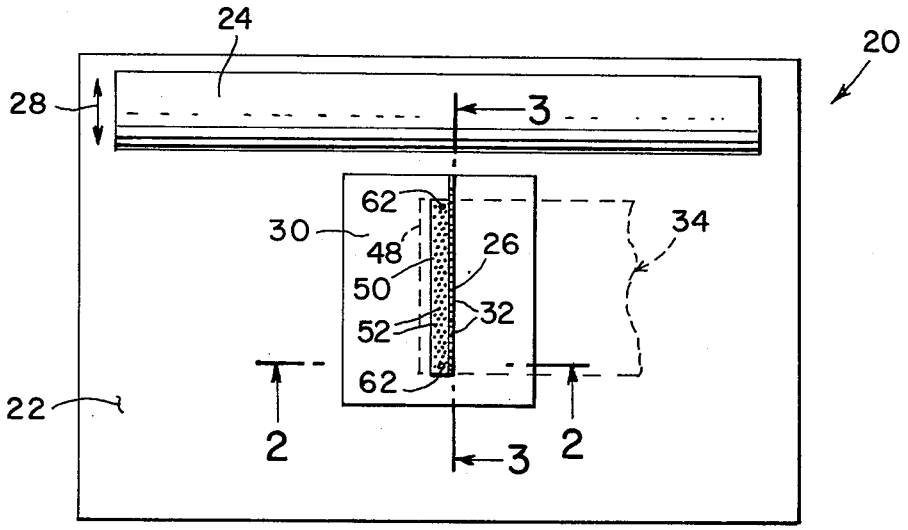
FIG. 1 is a top plan view of a press bed.
Figure 4:
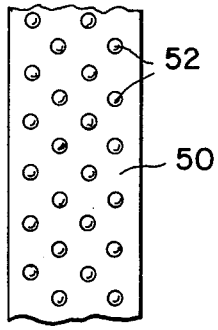
FIG. 4 is a top plan detail of the scarifying die of the invention.

Briefly, the bed 22 holds the rule, such as scoring rule 26 and the roller 24 rolls back and forth above the bed surface 22 in the direction of double headed arrow 28, as shown in FIG. 1. The blank 34 is placed between the roller 24 and the rule 26 to press the blank 34 against the rule 26 to make a folding score mark, such as mark 38. The scoring rule 26 is held in place by means of a holding block 30 which is positioned over and held to the top surface 22 of the press bed. The holding block 30 is provided with a slot 31 into which scoring rule 26 is fitted so that scoring rule 26 will rest on the bed 22 as held in position within slot 31 of the block 30.

Scoring rule 26 may be provided with teeth 32 whose upper edges form a tooth scoring line 36 to make a score line such as score line 38 in blank 34. Similar score lines 40, 42 and 44 may also be made in the blank 34 by means of other scoring rules (not shown) during the same operation in which score line 38 is made, it being understood that only one scoring rule 26 is illustrated in the drawings, but as many scoring rules can be included over the press bed as may be required for the operation to be done by the press 20. In addition, cutting rules or knives (not shown) may also be included to size and form the blank 34. These knives and rules are well known in the art and the term rule, or scoring rule, is intended to cover both cutting and scoring elements.

Figure 5:
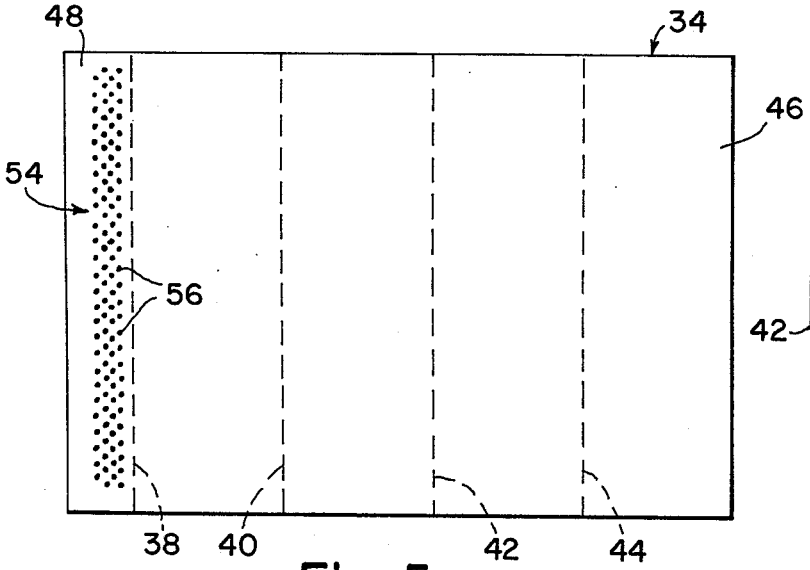
FIG. 5 is a bottom plan view of a paper or board blank produced by the press of the invention including the scarifying die.

Reference is now made to FIG. 5 of the drawings which shows the bottom plan view of a blank 34. Blank 34, as shown in FIG. 5, has been processed by being placed in a press such as press 20 to provide for the four score lines 38, 40, 42 and 44. The blank may then be folded into the structure as shown in FIG. 6 by folding along the four score lines. The folding forms a flap 46 at one end and a flap 48 at the other end. The flap 48 is folded over the flap 46 and glue or other adhesive 49 is applied between the flap surfaces along the line indicated by the X marks in FIG. 6. Flaps 48 and 46 are then held together until the adhesive or glue takes hold and a boxlike structure 64, as shown, is formed having four sides. Although not shown in the drawings, the boxlike structure 64, as well as the blank 34, may provide for box ends. These are not shown as this is not necessary to the description of this invention, however, it is understood that any type of blank to form a boxlike structure or frame may be produced with the invention which may be cut to include extra tabs to make end portions.

THE SCARIFYING MEANS

The principal feature of the invention is the scarifying means 50. Scarifying means 50 may be made of any material such as a block of steel or other metal, or laminates of material or a solid block of material, such as wood or plastic, or any other material which can be provided with scarifying element extensions 52. The scarifying extensions 52 extend over a surface of the scarifying means 50, and in the preferred form of the invention are in the form of protuberances which will press into the bottom surface of the blank 34 upon pressure applied by the roller 24 to form a scarification area 54 made up of a series of depressed or scarified pocks, or marks, 56. Thus the scarified area 54 is a part of the surface of the paper or board of blank 34 which has been roughened, scarred, and/or pocked by the scarifying means 50 and its extensions 52. This forms pock areas or roughened areas on the surface of the blank 34 to which the glue or adhesive 49 will readily adhere in its flowing or tacky state and to which the glue 49 will become more firmly affixed when it becomes hard and solidifies.

Figure 2:
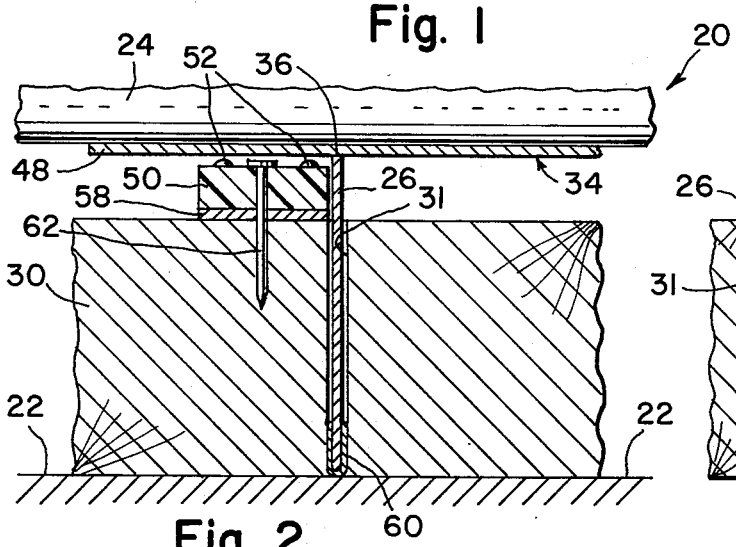
FIG. 2 is a sectional view of a detail along the lines 2—2 in FIG. 1.
Figure 3:
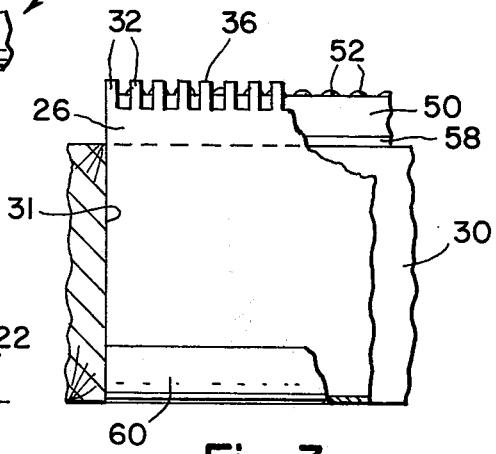
FIG. 3 is a sectional detail along the lines 3—3 in FIG. 1.

While the scarifying extensions 52 are shown as rounded protuberances in the preferred form of the invention, they may be in the form of points or irregularly shaped extensions or of any other shape or form provided they can scar or roughen the surface of the paper or board to produce a pocked or scarified area such as area 54. In the preferred form of the invention it is desirable to have the uppermost position of the scarifying extensions 52 somewhat below the uppermost level 36 of the scoring rule 26. For this purpose both the scoring rule and the scarifying means 50 are made adjustable by means of shim. The scarifying means 50 has shim means 58 between it and the holding block 30 and the scoring rule 26 has a shim means 60 wrapped around its bottom so that it may be adjustably spaced above the bed 22. The shims 58 and 60 are illustrated in FIGS. 2 and 3 of the drawings.

Scarifying means 50 may be held in position to block 30 by means of nails 62, as shown, or by any other means available and suitable.

METHOD OF OPERATION

The press 20 is operated by setting it up as described hereinabove, and as illustrated in the drawings, then by placing a blank 34 over the rules, such as scoring rule 26, and the scarifying means 50. Blank 34 is so sized and spaced that a flap such as flap 48 will be formed at one end by the cooperation of scoring rule 26 and scarifying means 50. Roller 24 is then rolled over the blank 34, pressing it into the scoring rule 26 and the scarifying means 50. The blank 34 is then removed and the bottom of the blank will appear as in FIG. 5.

Flap 48 will include the scarified area 54 adjacent score line 38. The glue 49 is applied over the scarified area 54 by any means known to the art. Flap 48 is then pressed over flap 46 and the flaps are held together until the glue dries, thus completing the construction. The bond made by the glue, as at reference numeral 49, will be stronger than a bond which did not include a scarified area, such as area 54, since the glue or other adhesive 49 will find footholds or grips in the pocks or scarred portions 56.

The invention has been described with a type of glue or adhesive which flows and is tacky and then becomes hard and gripping. It is to be understood that any type of adhesive may be used which may have the advantage of gripping into the pocks or scars 56 of the invention and it is not desired to be limited to any particular type of glue or adhesive.

While I have described my invention in its preferred form, there are many forms which it may take without departing from the spirit and scope of the invention and I therefore desire to be protected for all forms coming within the scope of the claims hereinbelow.

Wherefore I claim:

1. Scarifying means intended for use in a press, comprising a press bed and pressure applying means for processing at least one blank of paper, board or the like: comprising scarifying elements which when pressed together with said blank forms a scarified area on at least one portion of a surface of said blank for which an application of adhesive is intended; in which the scarifying means is mounted relative to the press bed with the scarifying elements between the press bed and the pressure applying means with provision for the blank to be held between the pressure applying means and the scarifying elements.

2. The device as claimed in claim 1 which also comprises at least one rule means intended for scoring, or cutting, the blank.

3. The device as claimed in claim 2, in which the scarifying means in mounted over the press bed.

4. The device as claimed in claim 3, in which at least one rule is mounted over the press bed by means of holding means in alignment with the scarifying means.

5. The device as claimed in claim 4, in which the scarifying means comprises scarifying elements in a configuration adjoining and parallel to the rule means.

6. The device as claimed in claim 4, in which the scarifying means are formed in a surface configuration relatively lower from the pressure applying means than the edge of the rule.

7. The device as claimed in claim 6, in which the scarifying elements extend above a surface of the scarifying means for a distance less than the thickness of the board intended for processing.

8. The device as claimed in claim 6, in which the pressure applying means is a pressure roller adapted to ride over the press bed.

9. The device as claimed in claim 6 which includes adjustment means for the scarifying means and the rule means.

* * * * *